US009120134B2

(12) United States Patent
Guo et al.

(10) Patent No.: US 9,120,134 B2
(45) Date of Patent: Sep. 1, 2015

(54) METHODS OF SHIFTING AND BENDING ROLLS IN A ROLLING MILL

(75) Inventors: Remn-Min Guo, Farmington, CT (US); Alfred Armack, Meriden, CT (US); Paul DiNello, Northford, CT (US); John Herbst, Bonita Springs, FL (US); Jerry Martin, Ansonia, CT (US); Wadaw Mielicki, Berlin, CT (US)

(73) Assignee: I2S, LLC, Yalesville, CT (US)

( * ) Notice: Subject to any disclaimer, the term of this patent is extended or adjusted under 35 U.S.C. 154(b) by 980 days.

(21) Appl. No.: 13/281,900

(22) Filed: Oct. 26, 2011

(65) Prior Publication Data

US 2013/0104617 A1 May 2, 2013

(51) Int. Cl.
*B21B 29/00* (2006.01)
*B21B 31/32* (2006.01)

(52) U.S. Cl.
CPC *B21B 29/00* (2013.01); *B21B 31/32* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,753,542 | A * | 8/1973 | Sloyan | 248/657 |
| 4,369,646 | A | 1/1983 | Kajiwara | |
| 4,499,748 | A | 2/1985 | Nihei et al. | |
| 4,531,394 | A | 7/1985 | Turley et al. | |
| 4,537,057 | A | 8/1985 | Kajiwara et al. | |
| 4,691,548 | A | 9/1987 | Richter et al. | |
| 4,736,609 | A * | 4/1988 | Schiller et al. | 72/244 |
| 4,744,235 | A | 5/1988 | Schiller | |
| 4,781,051 | A | 11/1988 | Schultes et al. | |
| 4,967,582 | A * | 11/1990 | Bohnenkamp | 72/247 |
| 5,239,851 | A | 8/1993 | Takakura et al. | |
| 5,724,846 | A | 3/1998 | Wang et al. | |
| 6,868,707 | B2 * | 3/2005 | Nishi et al. | 72/11.9 |
| 7,004,002 | B2 | 2/2006 | Nishi et al. | |
| 7,021,105 | B2 * | 4/2006 | Drigani et al. | 72/241.8 |
| 7,086,264 | B2 | 8/2006 | Seidel et al. | |

FOREIGN PATENT DOCUMENTS

| | | | | |
|---|---|---|---|---|
| JP | 62009708 A | * | 1/1987 | B21B 29/00 |

* cited by examiner

*Primary Examiner* — Shelley Self
*Assistant Examiner* — Pradeep C Battula
(74) *Attorney, Agent, or Firm* — Mark V. Loen

(57) ABSTRACT

An improved roll bending system is described for the work rolls and intermediate rolls in a six high mill. New bending blocks apply improved roll bending forces to the roll chocks, and additionally, are designed to move vertically and rotate, which provide important benefits to maintenance and enhance the rolling operation. Additionally, important related details to the mill operation and bending blocks provide operational improvements during roll changing.

11 Claims, 9 Drawing Sheets

METHODS OF SHIFTING AND BENDING ROLLS IN A ROLLING MILL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR COMPUTER PROGRAM LISTING

Not applicable.

BACKGROUND OF THE INVENTION (1) Field of the Invention

This invention is directed to vertical stack (2,4,6 high) rolling mill stands used to roll out flat rolled metal products, particularly metals such as steel and aluminum, to a reduced gauge using a pair of work rolls that are between intermediate rolls, which in turn are between backup rolls. Vertical stack rolling mill stands include work rolls, and optionally, intermediate rolls and backup rolls. It is also directed to mills where the rolls are used for controlling the shape of the metal during rolling by applying significant bending forces on the roll ends.

(2) Description of Related Art

Currently, in the art, there is a need for improvement in roll bending design so that the bearing and hydraulic cylinder maintenance is lowered for a vertical stack rolling mill. Process needs for roll bending have caused higher bending forces with subsequent higher roll end deflections. Also, operating practices have changed which have caused the work rolls and intermediate rolls to be shifted perpendicular to the rolling direction for improved shape and edge performance, and these practices have raised important issues with regard to the placement of end bending forces. Current designs for work roll and intermediate roll chocks generally constrain them to vertical movement which causes the bearing raceways to pinch, gouge, or otherwise behave in ways that reduce the bearing life since the resultant force is not at the bearing center when the roll is shifted. There is also higher roll end maintenance when the ends have to be re-machined. Also, some current designs apply hydraulic forces in the positive bending direction only, which is less desirable.

Additionally, there is the need to provide for a rapid method of inserting rolls into the mill, which will also accommodate the need for a roll to be driven, but allow the use of a shifting mechanism to be the means by which the rolls are kept in the mill. In a typical, non-shifting mill arrangement, keeper plates are used to 'lock in' rolls into the mill window. In a shifting roll arrangement, it is important that the rolls maintain their engagement in the drive system at all times, and that the shifted position of the rolls is highly positive and precise.

Improved designs for inserting rolls into the mill without the need for electrically actuated clamping or lock in plates are of benefit if the rolls utilize a mechanical system rigid enough to hold the rolls in place during the rolling operation. There are production benefits to locking in rolls mechanically, rather than by a sequence of hydraulic/electronic actuators, due to the need to verify actual lock in and motion to ensure successful operation.

Others have worked on rolling mill designs. U.S. Pat. No. 4,537,057, for example, describes a six high rolling mill and certain features to reduce edge cracks in the sheet during rolling. FIGS. 4 and 5 in particular show improved mill window equipment and methods to apply rolling force to the metal strip work piece. The disclosed method, however, requires a large number of hydraulic cylinders to create the roll bending effect in the work roll and intermediate rolls, which causes maintenance issues and complicated control/operational problems. The bending effect ends up being applied to the work roll chocks less effectively, by use of a machined area in the chocks in a way that creates un-needed high stress points. The end result is that the work roll and intermediate roll chocks require a lot of machining, and therefore a high expense due to the complicated geometry required. Finally, the roll changing method is not described as to efficiency. Another patent, U.S. Pat. No. 7,004,002 has similar issues.

U.S. Pat. No. 4,744,235 incorporates push/pull hydraulic cylinders to provide backup roll and work roll bending forces. It also includes compact designs for the work roll and intermediate roll chocks. It includes complicated horizontal hydraulic cylinders to steady and clamp the work rolls into position which adds to maintenance and complicates the operation of the overall system. The roll bending design causes significant moments in the roll chocks as well as end rotations. There is no allowance for this in the design causing the hydraulic cylinders to carry the resultant stresses and therefore incur significant maintenance.

U.S. Pat. No. 7,086,264 describes a six high mill stand with rolls that are inserted into the mill with a release able connection using a clutch type arrangement. This type of arrangement is suitable for a rotating connection, but not adequate for a rapid connection where the rolls shift perpendicular to the rolling direction.

U.S. Pat. No. 4,369,646 describes a hydraulic keeper system where shiftable rolls are kept in a mill stand. However, the hydraulic means of actuation to keep the rolls connected to the shifting mechanism is a less desirable method due to the need for portable hydraulics, hoses, maintenance, etc.

These designs and attempts by others are lacking in important technical aspects, especially in light of current trends in the industry, and improvements in mill design to address these issues is greatly desirable.

BRIEF SUMMARY OF THE INVENTION

The present invention incorporates an integrated hydraulic cylinder design that improves bearing life by allowing the roll chock to rotate along with the end shaft of the roll. Also, the design includes improvements in bending cylinder design by utilizing multiple cylinders on the end, so that the center of force application on the end is neutral and applied to the roll end with a torque that allows the bearing to naturally rotate. The design further includes an improved cylinder design which allows use of a standardized double acting cylinder which is bolted into the project block on the window housing, and therefore allows for rapid and easy maintenance in the event of a problem.

BRIEF DESCRIPTION OF THE SEVERAL VIEWS OF THE DRAWING(S)

DETAILED DESCRIPTION OF THE INVENTION

FIG. 1 is one embodiment of the mill window as conceived in the present invention. For convenience, Table 1 lists the features in the mill window as particularly directed to the roll bending. Other features of the mill are not shown.

TABLE 1

| FIG. 1 | |
|---|---|
| 101a, b | Back Up Roll (Lower and Upper) |
| 102a, b | Intermediate Roll (Lower and Upper) |
| 103a, b | Work Roll (Lower and Upper) |
| 104a, b | Left Intermediate Roll Bending Block (Lower and Upper) |
| 105a, b | Left Work Roll Bending Block (Lower and Upper) |
| 107a, b | Right Intermediate Roll Bending Block (Lower and Upper) |
| 106a, b | Right Work Roll Bending Block (Lower and Upper) |
| 110a, b | Left Lower Intermediate Roll Bending Block Cylinders |
| 111a, b | Left Lower Work Roll Bending Block cylinders |
| 112a, b | Left Upper Work Roll Bending Block Cylinders |
| 113a, b | Left Upper Intermediate Roll Bending Block Cylinders |
| 114a, b | Right Lower Intermediate Roll Bending Block Cylinders |
| 115a, b | Right Lower Work Roll Bending Block Cylinders |
| 116a, b | Right Upper Work Roll Bending Block Cylinders |
| 117a, b | Right Upper Intermediate Roll Bending Block Cylinders |
| 120 | Left Project Block |
| 121 | Right Project Block |
| 122 | Mill Housing |
| 123 | Flat Rolled Metal Product, Rolling Passline |
| 124 | Cylinder Housing (typical example) |
| 125 | Bolts |
| 130a, b | Intermediate Roll Chocks (Lower and Upper) |
| 131a, b | Work Roll Chocks (Lower and Upper) |

Figure 1A:
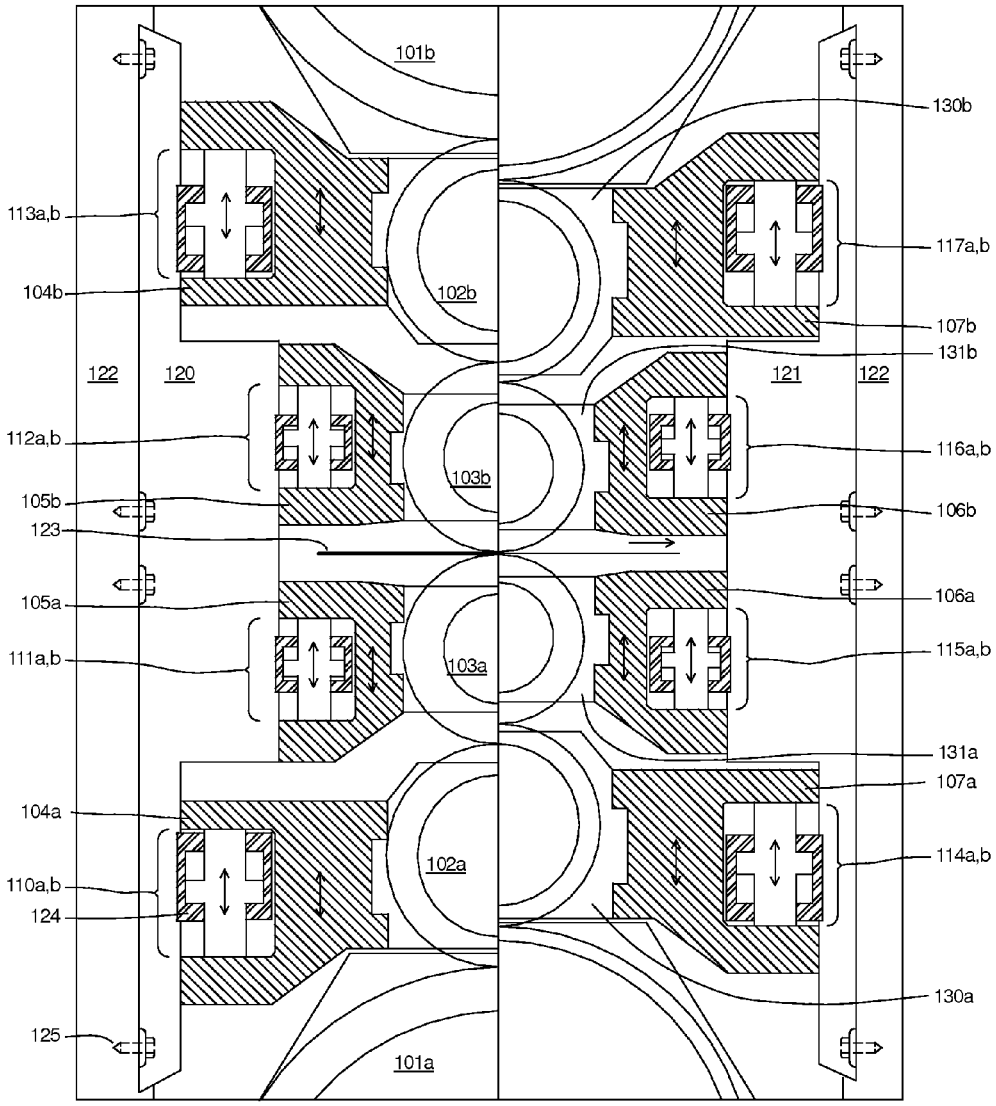
FIG. 1A-1B show an elevated view of the mill window design for a six high and a four high rolling mill stand.

In FIG. 1A, the backup rolls 101*a,b* are shown on the left and right side of the mill window elevation view in their maximum and minimum diameter respectively. This is a common way of illustrating a mill window. As is seen, the intermediate rolls 102*a,b* and work rolls 103*a,b* are also similarly shown. This provides perspective on typical maximum motions of the mill window equipment in normal operation. For a roll change, the pistons will move more to create clearance between the rolls. FIG. 1A is only one embodiment of the invention; other arrangements could be adapted and used, such as a two high (i.e. two work rolls) or a four high (two work rolls and two backup rolls).

The work roll ends have bearings which are inside work roll chocks 131*a,b*. Similarly, the intermediate rolls have chocks 130*a,b* as well. In this design, bending blocks 104*a,b*, 105*a,b*, 106*a,b*, and 107*a,b*, also called bending project blocks or chock holding blocks, are used to guide the work roll or intermediate rolls into the mill as well as provide the force needed to bend the rolls for roll crown management and for strip shape control. When a roll is bent in a way that causes the roll to appear thicker in the middle, it is called 'crown in' or positive bending. This would occur when the ends of the upper work roll, for example, are pushed upwardly and the middle of the roll bows into the strip. The opposite way of bending it is called 'crown out' or negative bending.

The force needed to create roll bending effects in the present invention is developed by hydraulic cylinders that are rigidly attached to project blocks 120, 121 that are, in turn, attached to the mill housing 122. The roll bending hydraulic cylinders are explained further in FIG. 2. There are sixteen cylinders per mill side, or a total of thirty two per mill stand. The Work roll lower left bending block cylinders 111*a,b*, for example, on the operator side of the mill, comprise two cylinders in line, and attached to the mill left project block 120. They are used to push the lower work roll bending block 105*a* up and down to provide both crown out and crown in roll bending respectively.

Similarly, the roll bending hydraulic cylinders 110*a,b*, 112*a,b*, and 113*a,b* are also attached to the left project block 120. They are used to push the lower intermediate roll bending block, upper work roll bending block, and upper intermediate roll bending block up and down to provide crown management. Similarly, the roll bending hydraulic cylinders 114*a,b*, 117*a,b*, 115*a,b*, and 116*a,b* are also attached to the right project block 121. They provide lower/upper intermediate roll bending block movement, and lower/upper work roll bending block movement respectively.

The force needed to create roll bending effects in the present invention is developed by hydraulic cylinders that are designed with maintenance in mind. In one embodiment, the cylinders are double rod, and designed in a manner that allows for easy maintenance and replacement by utilizing a standard cylinder or a modularized cylinder design. This provides for rapid replacement and repair as opposed to custom design and repair where in place repair is complicated. Methods of attachment to the project block, consider such things as power tools and accessibility. The bending block design is such that the cylinders can be unbolted, removed, and replaced easily.

A typical cylinder housing 124 is rigidly attached to the project block 120, though the method of attaching is not illustrated. A mechanical attaching method is preferred, such as by bolts or a hardware method.

The project blocks 120, 121 are rigidly attached to the mill housing 122 in this illustration by a bolt method 125, though other rigid methods could equally be used. The flat metal product 123, such as steel or aluminum, is aligned to the rolling mill centerline, i.e. strip passline, or rolling passline, and is defined location (typically a specific elevation or a small range of elevations) for a particular mill housing pair 122. Typically, only one housing is illustrated and a second mill housing on the other side of the rolling passline is implied by the illustration for a rolling mill stand unless otherwise explained. Both mill housings for a rolling stand are typically set on a rigid foundation.

Figure 1B:
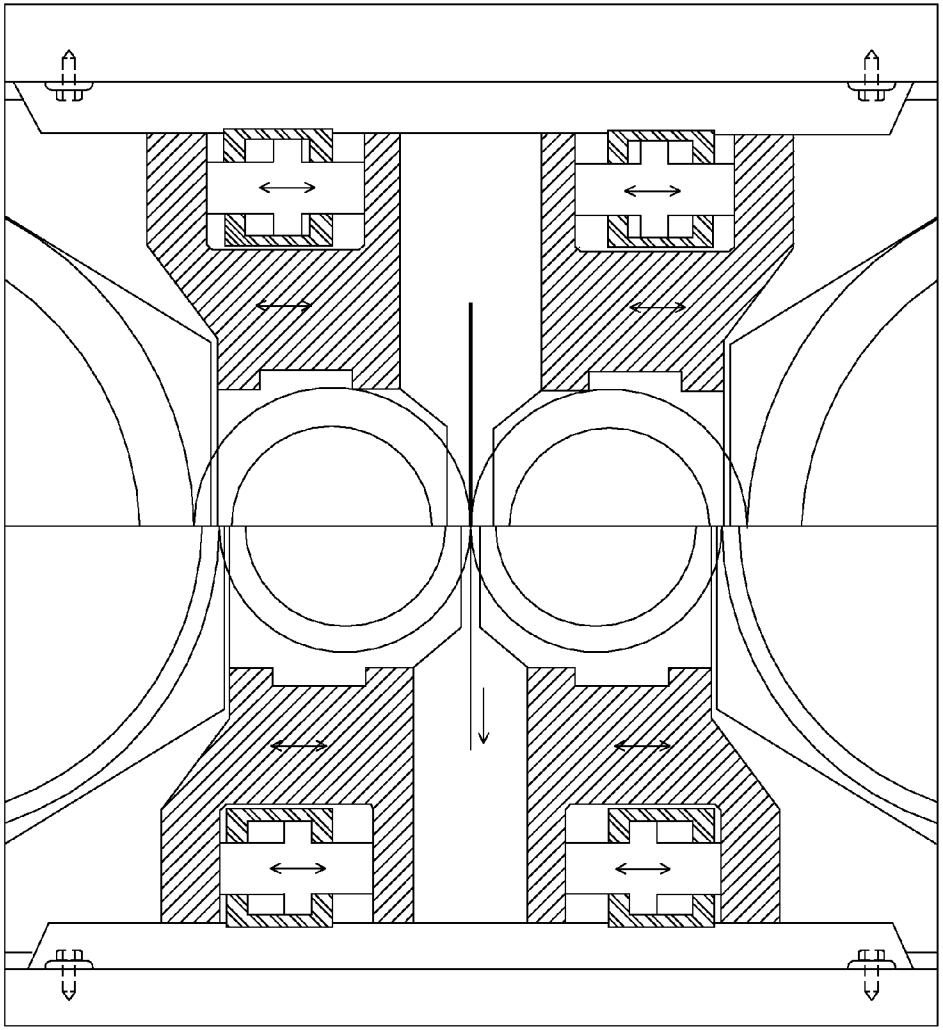

Similarly, FIG. 1B shows a four high mill stand arrangement with a pair of work rolls and supporting backup rolls. The intermediate rolls and back up rolls in FIG. 1A (and backup rolls in FIG. 1*b*) could also be called support (or supporting) rolls. The associated equipment such as chocks, etc. are called associated supporting chocks, etc.

Figure 2E:
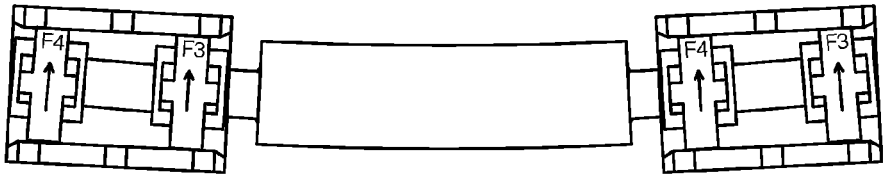
FIGS. 2A-2E illustrate roll shifting and the advantage of the invention by the use of dual inline bending cylinders, including chock rocking to reduce stress concentration.
Figure 2D:
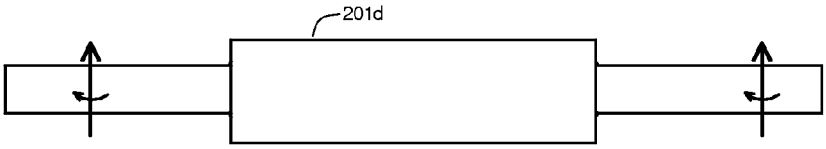
Figure 2C:
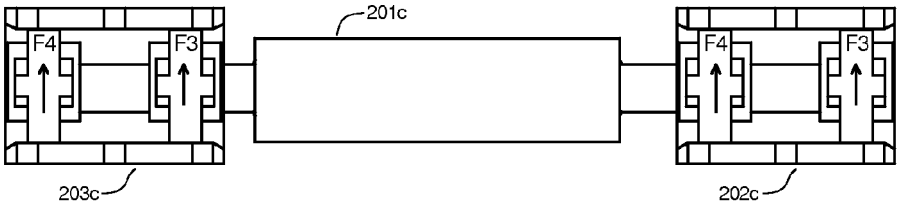
Figure 2B:
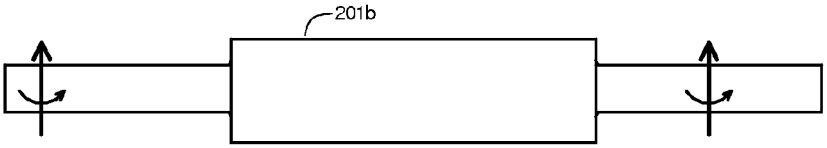
Figure 2A:
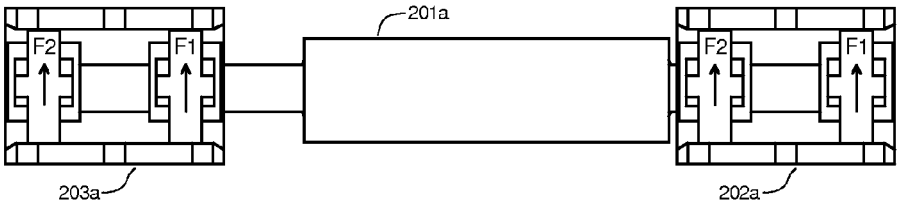

FIGS. 2A-2D illustrate a shifting work roll 201*a-d*, but would also illustrate a shifting intermediate roll. In FIG. 2A the forces created by the bending cylinders, F1 and F2 are shown through the bending blocks 202*a*, 203*a*, which result in the forces and applied torsion in FIG. 2B. The hydraulic cylinders are interconnected by piping in a manner so that the forces F1 and F2 are created as shown (and will be discussed in FIG. 4). In consideration of the bending and deflection of the ends of the actual work roll, the two torsions shown in FIG. 2B will actually improve the bearing mounting on the work roll end, and avoid issues with higher maintenance caused by the shifting work roll. Also, the torsion will also counteract the shifting location of the applied overall bending force location.

Similarly, FIGS. 2C, 2D illustrate a work roll that has shifted somewhat to the left of the mill center. Even though the roll is close to center, the same issue of roll bearing and mounting still applies, even if the torsion amount is relatively smaller.

FIG. 2E shows how the bending moments affect the rotation of the end bearing blocks for a crown in bending force when the roll is above the metal strip (in an exaggerated illustration). The applied bending force is ultimately resisted by the inherent stiffness of the roll itself. As shown, the chocks 'rock', that is, they are allowed to rotate slightly with the roll ends to avoid bearing stress concentrations.

Figure 3A:
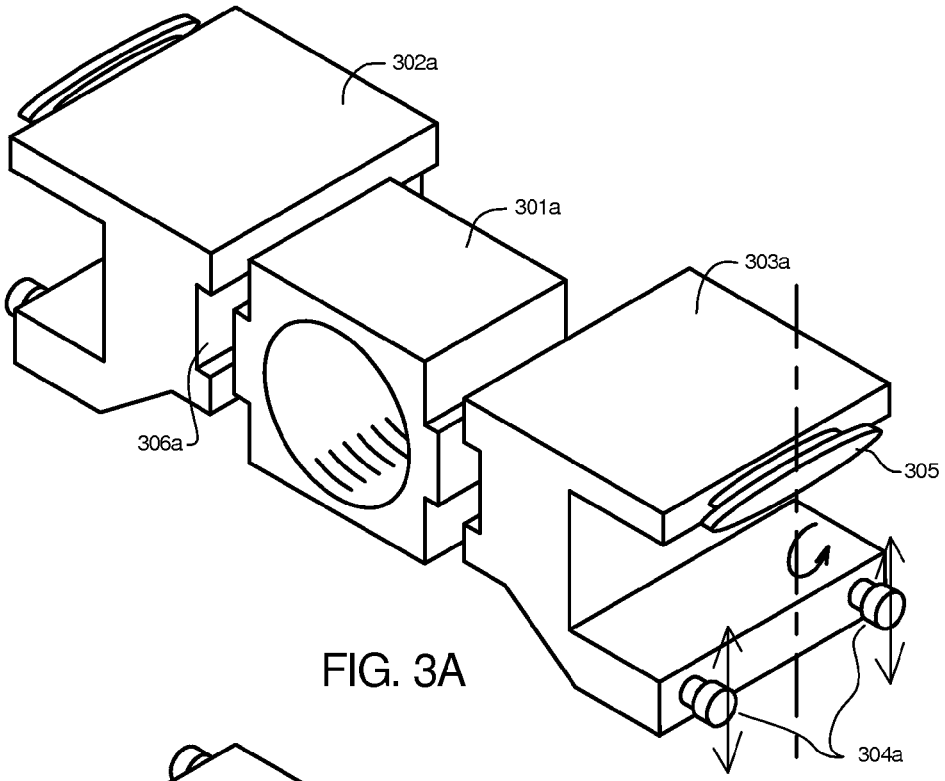
FIGS. 3A-3B illustrate how the bending block incorporates design features which allow for small rotations.
Figure 3B:
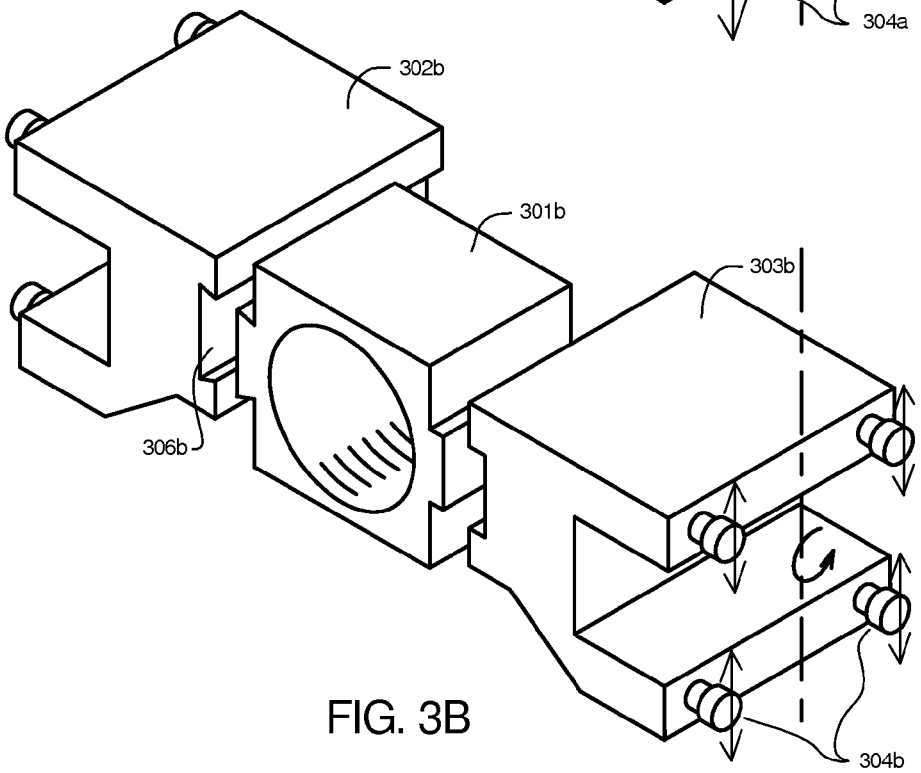

FIGS. 3A-3B illustrates a method where the work roll chock 301*a,b* (or alternately, intermediate roll chock) along with a right bending block 303*a,b* and left bending block 302*a,b*, are designed to provide a small amount of rotational movement with respect to the mill housing face. To this end, Guide Pins 304*a,b* are rigidly attached to the bending blocks (along with an alternative guide plate 305 as illustrated in FIG. 3A only) to allow the bending block to move vertically, but allow rotational freedom of movement so that the work roll chock 301*a,b* rotates when the bending force is applied, which in turn, will allow the work roll bearing (not shown) to rotate with the bending work roll end shaft. Matching machined grooves for the guide pins are added to the mill housing faces, as well as a machined surface for the guide plate with suitable vertical side plates along the edges of the guide plate to capture it next to the mill housing face. This design is only one embodiment. The Guide Pins 304*a,b* (and guide plate 305) might be a variety of geometric shapes, or, might be a different number such as a minimum of three to a large number of pins, such as sixteen so as to allow an even distribution of surface stress.

In one embodiment, the interface between the work roll chock and the bending blocks is a dovetail arrangement 306*a,b* and a particular dovetail design may be adapted as is suitable to the task. Such interface designs include standard rectangular to a base with sides angled up to 15 degrees.

Figure 3C:
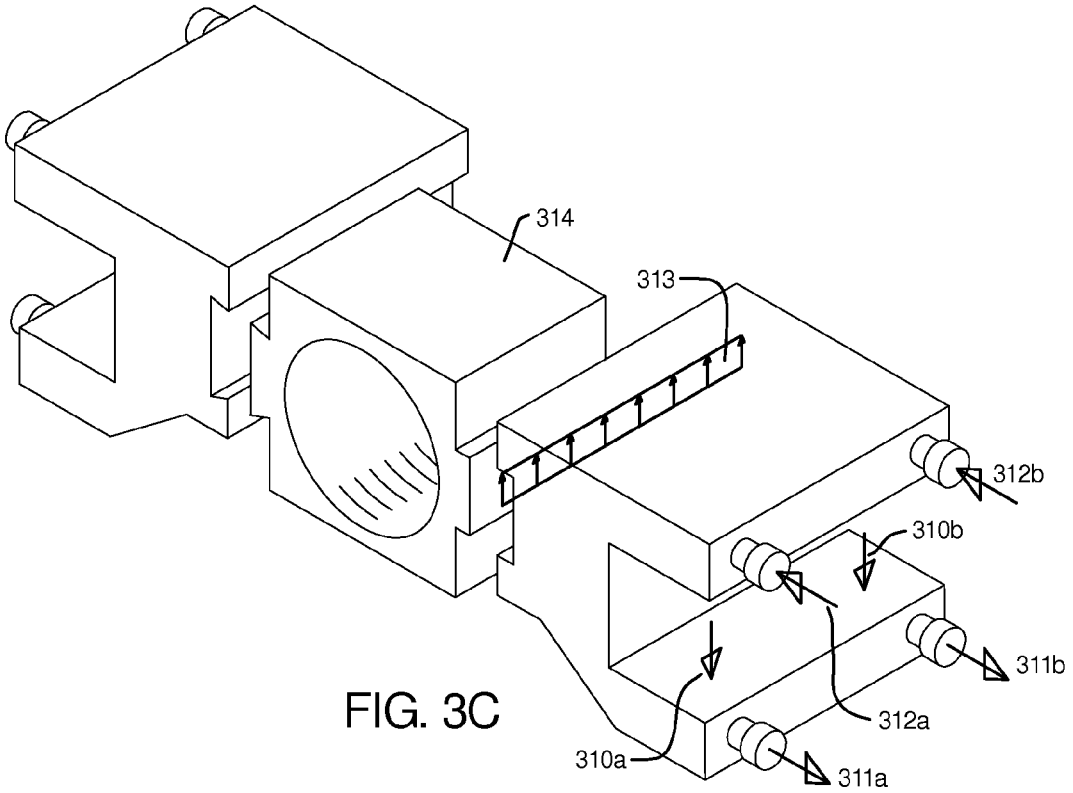
FIG. 3C shows a free body diagram of a Bending Block illustrating how the Guide Pins counter balance the applied bending force.

FIG. 3C shows a free body diagram of a Bending Block to illustrate how the Guide Pins counter balance the applied bending force. Bending Cylinders (not shown) oriented vertically apply bending forces 310*a,b* to the Bending Block (in this example downward direction). The force is applied to the Work Roll Chock 314 along an edge of the Bending Block resulting in an edge pressure 313. These forces create a moment which is counter balanced by the Upper Guide Pin forces 312*a,b* and lower Guide Pin Forces 311*a,b*. A force applied to the Guide Pins may be in either direction due to the method by which the Guide Pins are held against the project block—a slot with a groove, which allows the head of the pin to carry either a tensile or a compressive load. The slot is wide enough to allow the bending block to rotate along with the work roll chock rotation due to roll end deflection, but the slot is narrow enough to keep the head of the Guide Pins captured.

Figure 4:
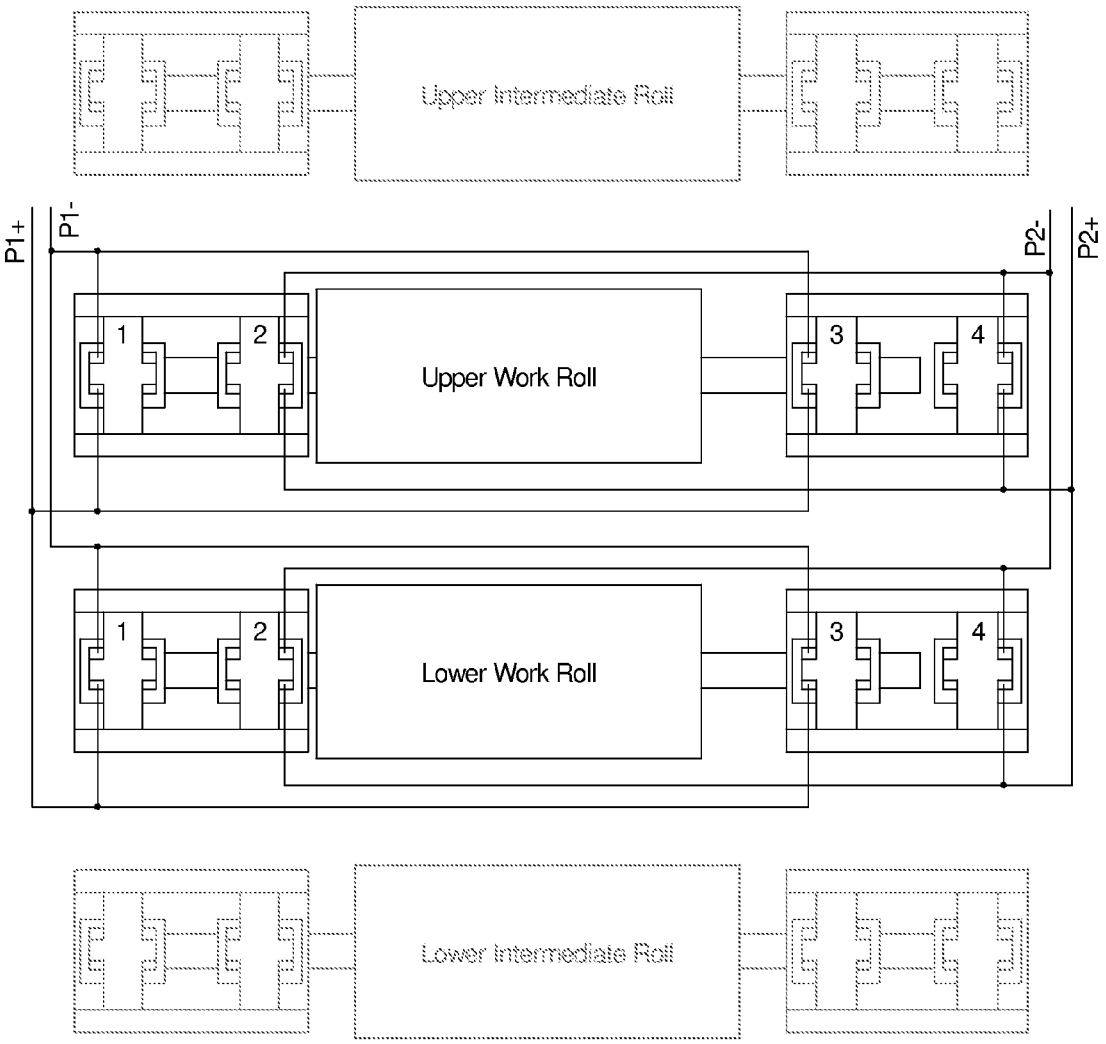
FIG. 4-5 illustrate how the hydraulic circuit is designed to provide good bearing life by balancing the placement of the bending force on the ends of the shifted roll.
Figure 5:
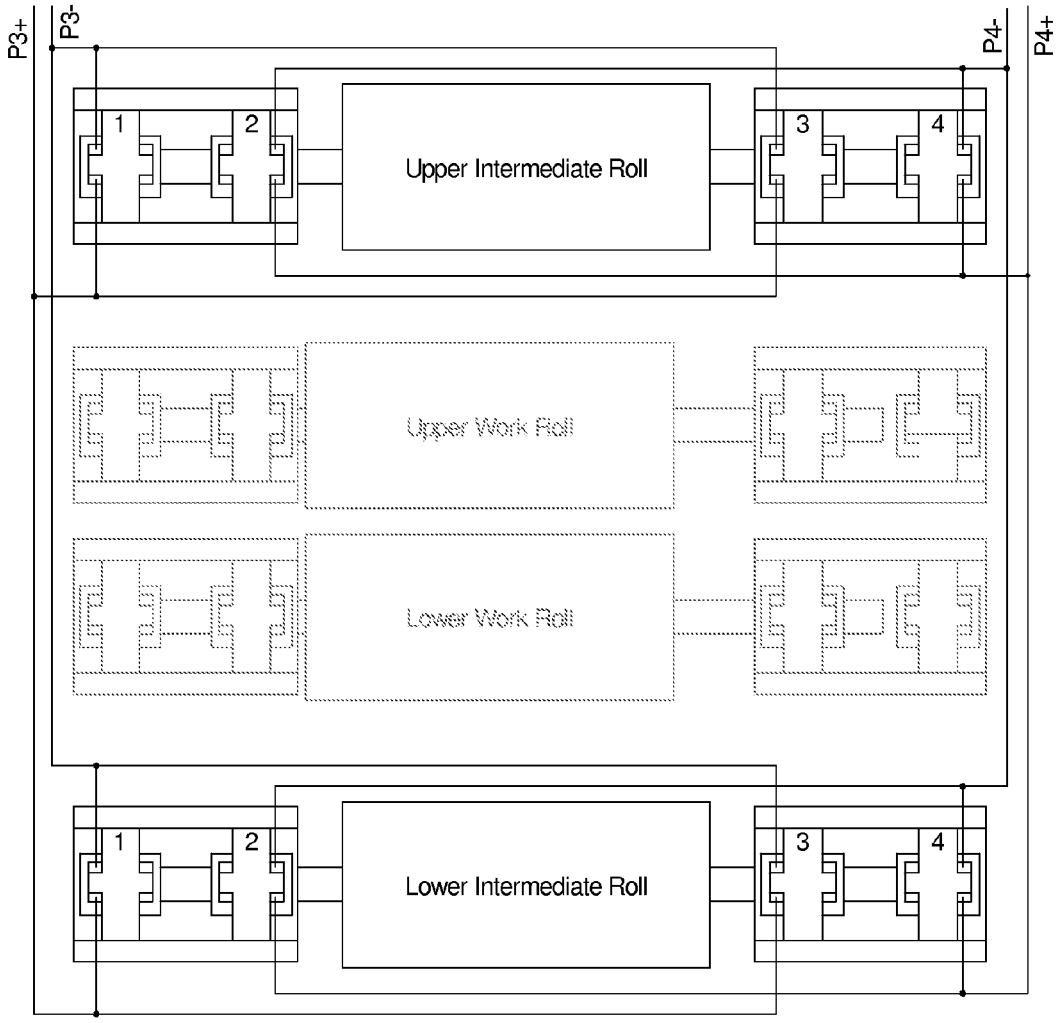

FIGS. 4 and 5 illustrate an abbreviated piping schematic of the hydraulic pressure system that provides the needed pressure in the bending cylinders for the work roll and intermediate rolls. As seen in FIG. 4, the pressure P1+ is commonly interconnected by piping to the cylinders as shown in a manner that will develop the forces as previously illustrated in FIG. 2. The applied bending force between the left and right sides as viewing the mill window is carried out by repetition of the pattern shown in FIG. 4. The bending pressure P2+, is applied similarly to the positive bending pressure P1+ as shown. Similarly, the negative bending pressures P1−, and P2−, are applied as illustrated. The piping schematic illustrates the odd-even counting method of connecting the cylinders together, where the cylinders 1 and 3 (when counting in line from the left) are connected, and the cylinders 2 and 4 are connected together. The net result is that the odd numbered bending cylinders in the bending blocks are operated with a common pressure (and also the even numbered cylinders). By similarly designing bending block cylinders, the applied forces are the same. The cylinders in the bending blocks are set at a predetermined distance apart based on rolling mill parameters, such as the rolling width, gauge, material to be rolled, work roll diameter, intermediate roll diameter, and roll shifting dimensions.

As seen in FIG. 5, the pressures P3+/− and P4+/− are interconnected to the bending cylinders as shown in a manner similar to FIG. 4, so that forces will develop in the manner as previously illustrated in FIG. 2. It should be noted that the hydraulic pressures for the intermediate bending block cylinders are connected separately from the work roll system sufficiently so as to allow the intermediate rolls to develop different pressures and bending forces.

FIGS. 6A-6E show a latching method whereby a roll is easily and readily inserted into the mill, and also withdrawn when it is time to pull the roll out of service. The method applies to either a work roll or intermediate roll. This latching system is particularly useful for rolling mills where the rolls are shifted for the rolling operation, and devices like keeper plates have little use for containing the rolls in place.

Figure 6A:
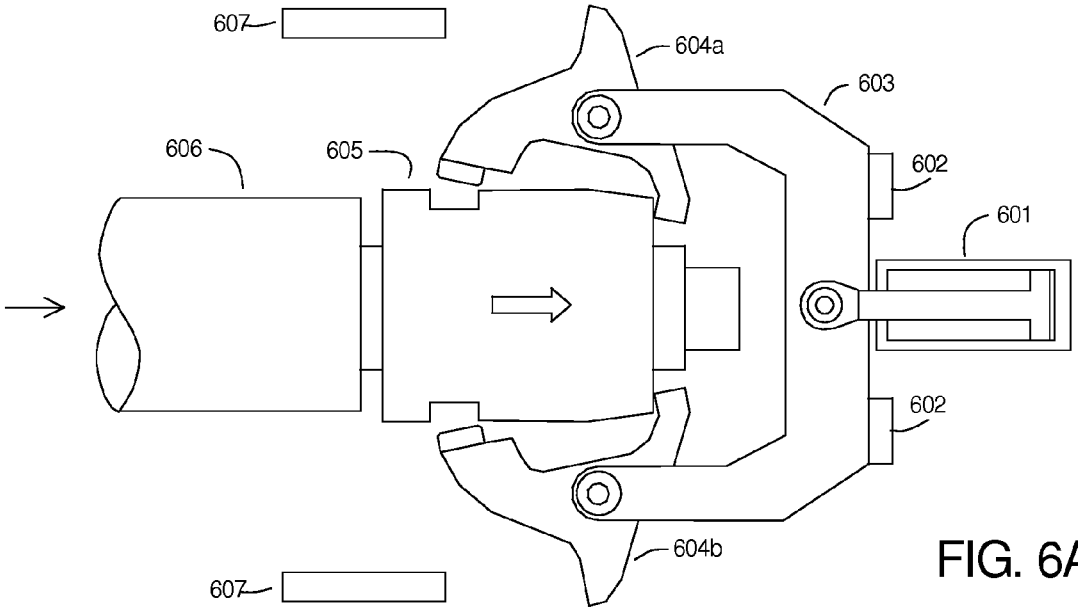
FIG. 6A-6B illustrate a latching in mechanism which allow for the work roll or intermediate rolls to be readily inserted into the mill.

In FIG. 6A, a roll 606 with associated chock 605, is being pushed into the mill. The equipment being used to latch the roll into its operating position includes: a hydraulic cylinder 601, C-Frame stop blocks 602, a C-Frame 603, Latch frames 604*a,b*, and Latch Frame Open Block 607. These elements are used to capture the roll chock and hold it for the rolling operation. The C-Frame 603 is already fully retracted against the stop blocks 602 by use of the hydraulic cylinder 601.

Figure 6B:
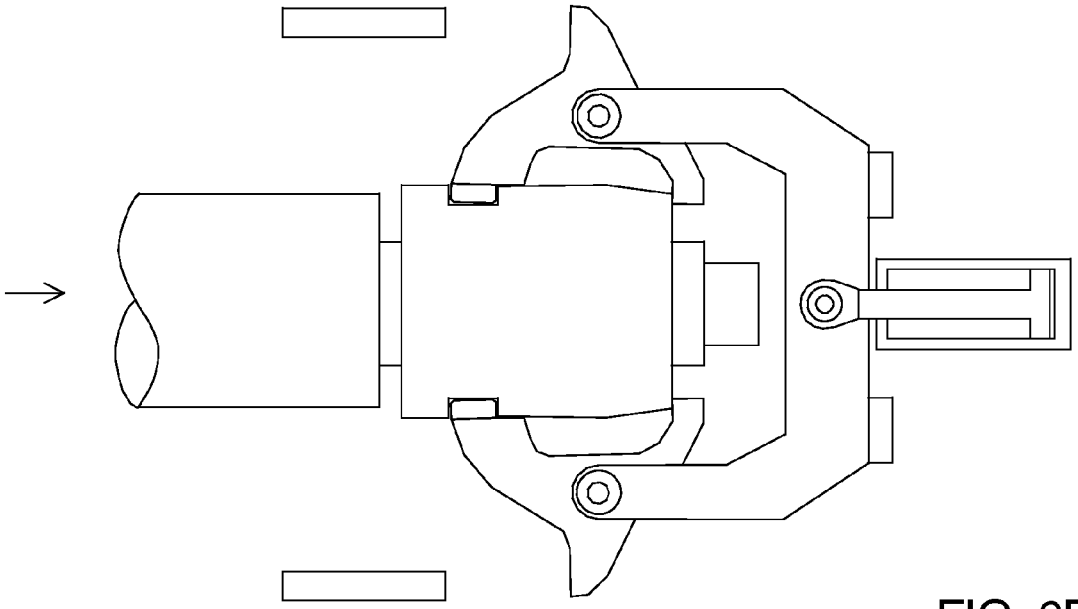

In FIG. 6B, the roll is pushed by the roll changer further against the latch frames, which rotate due to the end of the roll contact, and this causes the latch frames to rotate enough to lock one protrusion into a machined groove in the roll chock. This allows the latch frame to capture the chock, and, only allows the chock to leave when the hydraulic cylinder is actuated. This is also the minimum shifting position.

Figure 6C:
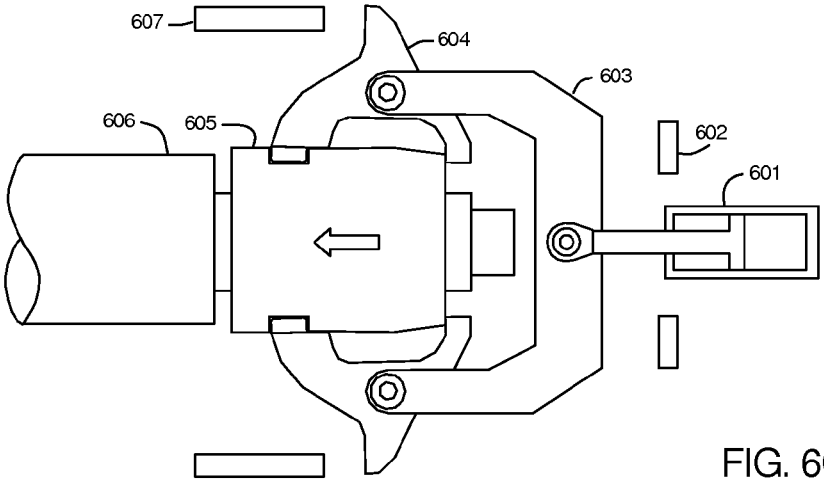
FIGS. 6C-6E illustrate how the latching mechanism is designed to release the work roll or and intermediate rolls from the mill.
Figure 6D:
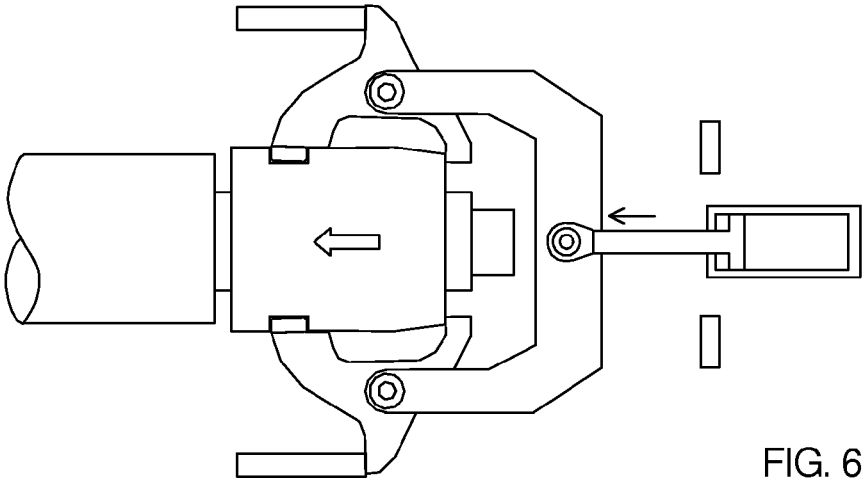
Figure 6E:
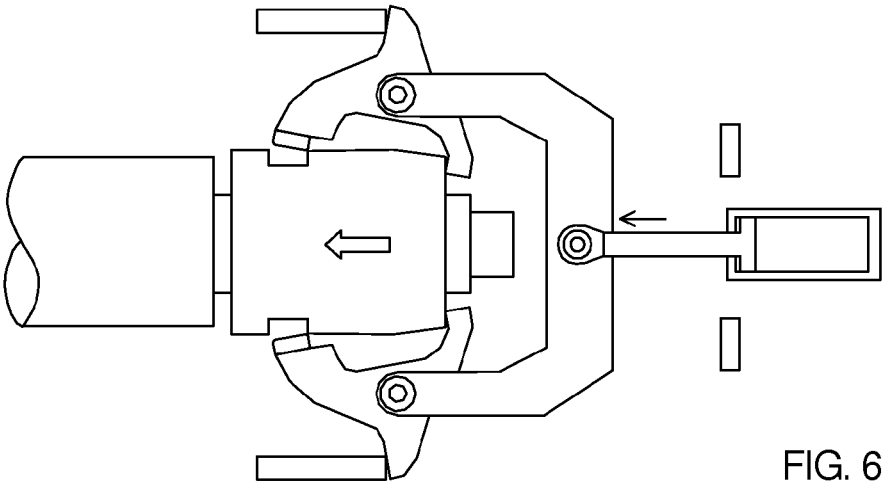

In FIG. 6C, the normal operational position of the work roll and C-Frame is shown. The work roll shifts horizontally in normal operation and the C-Frame will shift along with it because it is engaged/latched. To remove the roll and chocks, the hydraulic cylinder 601 is activated. In FIG. 6D, the C-Frame is additionally pushed by the hydraulic cylinder until the latch frame is pressed into the latch frame stop block. Additional push will generate a reaction from the stopper 607, which will introduce a large moment to open the latch frame. This mechanism releases the roll chocks from the latch frame by causing the latch frames to rotate as illustrated in FIG. 6E. FIGS. 6C-6E shows the cylinder pushing the latching frame to open. Alternately, the cylinder is an auxiliary device which allows the roll changer to pull out the roll and to open the latching frame.

This method applies to individual non-driven rolls, but could easily be adapted to a driven roll (i.e. motor with coupling on the end of the roll), by varying the geometry of the C-Frame in three dimensional space to provide room for the motor shaft and coupling, and alternately, any mill stand gearing. Another possibility is to provide a shaft connection between the Latch Frames and C-Frame rather than a simple pivot point so as to allow the C-Frame and Latch Frames to be at different elevations. Another method is to make the Latch Frame three dimensional so that the groove capture comes from extended arms from a higher (or lower) elevation. The latching mechanism is also locatable to the operator side of the mill, that is, the opposite side of the mill from where the motor/coupling are.

While various embodiments of the present invention have been described, the invention may be modified and adapted to various operational methods to those skilled in the art. Therefore, this invention is not limited to the description and figure shown herein, and includes all such embodiments, changes, and modifications that are encompassed by the scope of the claims.

We claim:

1. An improved rolling mill stand comprising:

a) a mill housing with a rolling passline for a flat rolled metal product, b) a plurality of project blocks, wherein said project blocks are rigidly attached to said mill housing, c) upper and lower work rolls and associated upper and lower work roll chocks, d) upper and lower work roll bending blocks which apply roll bending forces to said upper and lower work roll chocks, e) wherein said work rolls are shiftable relative to said mill housing in a substantially horizontal direction substantially perpendicular to said rolling passline, f) wherein each said bending block includes:

i) two bending cylinders, wherein each said bending cylinder is substantially centered in a plane that is parallel to the work roll shiftable direction, and ii) each said bending cylinder is capable of a similar force within each said bending block, g) wherein said bending blocks are hydraulically connected in an odd-even counting method when counting bending cylinders in line, h) wherein each said bending cylinder is rigidly attached to one of said project blocks, i) wherein each said bending block is guided vertically with respect to said project blocks, j) wherein each said bending cylinder is a double rod, and k) wherein each said bending block is rotatable along an axis that is substantially parallel to said rolling passline.

2. The improved rolling mill stand according to claim 1 wherein said rolling mill stand further comprises:

l) upper and lower supporting rolls and associated supporting roll chocks, m) upper and lower supporting roll bending blocks which apply roll bending forces to upper and lower supporting roll chocks, and n) wherein said upper and lower supporting rolls are shiftable relative to said mill housing in a direction substantially perpendicular to said rolling passline.

3. The improved rolling mill stand according to claim 2 wherein said work rolls bending hydraulic system pressure control is hydraulically separate from any said supporting rolls which have hydraulic bending systems.

4. The improved rolling mill stand according to claim 1 wherein said work roll chocks and said intermediate roll chocks incorporate a rectangular dovetail or a dovetail with sides angled up to 15 degrees.

5. The improved rolling mill stand according to claim 1 wherein each said bending block incorporates guide pins and a guide plate.

6. An improved method for bending rolls in a rolling mill housing, said method comprising:

providing a) a rolling passline for a flat rolled metal product, b) a plurality of project blocks, wherein said project blocks are rigidly attached to said rolling mill housing, c) upper and lower work rolls and associated upper and lower work roll chocks, and d) upper and lower work roll bending blocks, applying roll bending forces to said upper and lower work rolls through said upper and lower work roll chocks respectively by e) use of roll bending cylinders located within said upper and lower work roll bending blocks, f) wherein said roll bending cylinders are a double rod, g) wherein said upper and lower work roll bending blocks engage said upper and lower work roll chocks respectively, h) wherein each said bending block includes:

i) two bending cylinders, wherein each said bending cylinder is substantially centered in a plane that is parallel to the work roll shiftable direction, and ii) each said bending cylinder is capable of a similar force within each said bending block, i) wherein said bending blocks are hydraulically connected in an odd-even counting method when counting bending cylinders in line, j) wherein each said bending cylinder is rigidly attached to one of said project blocks, and k) wherein each said bending block is guided vertically with respect to said project blocks, wherein each said bending block is rotatable along an axis that is substantially parallel to said rolling passline, and providing for said work rolls to be shiftable relative to said mill housing in a substantially horizontal direction substantially perpendicular to said rolling passline.

7. An improved rolling mill stand comprising:

a) a mill housing pair with a rolling passline for a flat rolled metal product, b) a plurality of project blocks, wherein said project blocks are rigidly attached to said mill housing pair, c) upper and lower work rolls and associated upper and lower work roll chocks, d) upper and lower work roll bending blocks configured to apply roll bending forces to said upper and lower work roll chocks, e) wherein said work rolls are shiftable relative to said mill housing pair in a substantially horizontal direction, f) wherein each said bending block incorporates:

i) two bending cylinders oriented to provide a force substantially perpendicular to said rolling passline, ii) wherein said two bending cylinders are at a defined distance apart in a substantially horizontal direction according to a predetermined criterion, and iii) wherein each said bending cylinder is capable of a similar force within each said bending block, g) wherein said bending blocks are hydraulically connected in an odd-even counting method when counting bending cylinders in line, h) wherein each said bending cylinder is rigidly attached to one of said project blocks, and i) wherein each said bending block is guided vertically with respect to said project blocks, j) wherein each said bending cylinder is a double rod, and k) wherein each said bending block is rotatable along an axis that is substantially parallel to said rolling passline.

8. The improved rolling mill stand according to claim 7 wherein said rolling mill stand further comprises:

l) upper and lower supporting rolls and associated supporting roll chocks, m) upper and lower supporting roll bending blocks which apply roll bending forces to upper and lower supporting roll chocks, and n) wherein said upper and lower supporting rolls are shiftable relative to said mill housing pair in a direction substantially perpendicular to said rolling passline.

9. The improved rolling mill stand according to claim 7 wherein said work roll chocks and said intermediate roll chocks incorporate a rectangular dovetail or a dovetail with sides angled up to 15 degrees.

10. The improved rolling mill stand according to claim 7 wherein each said bending block incorporates guide pins and a guide plate.

11. The improved rolling mill stand according to claim 8 wherein said work rolls bending hydraulic system pressure control is hydraulically separate from any said supporting rolls which have hydraulic bending systems.

* * * * *